US005496007A

United States Patent [19]

Reece et al.

[11] Patent Number: 5,496,007

[45] Date of Patent: Mar. 5, 1996

[54] DEVICE FOR HOLDING OUT-SIZED DOCUMENTS

[76] Inventors: Cecil L. Reece, 4016 6th Ave., Los Angeles, Calif. 90008; Edmund Hansberry, 4569 W. 62nd St., Los Angeles, Calif. 90043; Edward Thurman, 2320 Bullis Rd., Compton, Calif. 90221

[21] Appl. No.: 263,948

[22] Filed: May 13, 1994

[51] Int. Cl.[6] ..... A47B 5/04

[52] U.S. Cl. ..... 248/441.1; 248/447

[58] Field of Search ..... 248/441.1, 447, 248/448, 449, 460, 462, 463, 291, 284

[56] References Cited

U.S. PATENT DOCUMENTS

| | | | |
|---|---|---|---|
| 4,969,623 | 11/1990 | Bernier | 248/441.1 |
| 4,987,690 | 1/1991 | Aaldenberg et al. | 248/447 X |
| 5,337,996 | 8/1994 | Kalish | 248/460 |

*Primary Examiner*—J. Franklin Foss
*Attorney, Agent, or Firm*—Monty Koslover Assoc.

[57] ABSTRACT

A document holder that is either floor mounted or table mounted, capable of holding and displaying out-sized documents. The document holder is composed of a vertical stand, a support arm and assembly which is mounted on the stand so that it can rotate and an extension rod assembly which is suspended from the overhanging end of the support arm. The extension rod assembly includes horizontal rods to which out-sized documents can be attached and displayed. The holder includes provision for a seated user to be able to remotely adjust the height of the extension rod assembly or to swing the support arm and assembly in a horizontal arc to a desired location while remaining seated. An alternate configuration has a support stand with a horizontal rail on which the support arm assembly can ride from one end to the other. This adds a remote horizontal moving capability of displayed documents for a seated user where required for special applications.

8 Claims, 3 Drawing Sheets

DEVICE FOR HOLDING OUT-SIZED DOCUMENTS

BACKGROUND OF THE INVENTION

1. Field of the Invention

This invention pertains to out-sized document holding and positioning devices, principally in the fields of Engineering, Architecture and Manufacturing.

2. Prior Art

Where information is required from an out-sized document as input to a media other than itself, a patent search has revealed no precedent for the invention described herein.

In the Clerical/Administrative sector of our society there exist holding and positioning devices for letter size documents, (typically an "A" or legal size). However, these devices are of little or no use for holding and positioning the out-sized documents typically used in Engineering/Architecture/Manufacturing environments. These devices are fairly permanent in their placement and not easily moved, fragile in design and within themselves have rather limited movement in terms of positioning. One has to either place an out-sized document on a desk or adjacent structure, fold it into smaller sections for easier handling, or in some cases, place it on the floor.

Movement back and forth from the source media to the input media requires considerable exertion and disrupts continuity of thought. This is especially true in cases where the input media is a computer terminal.

There is therefore, a perceived need for a device that can support out-sized documents in a manner that the user can easily refer to the documents without extra exertion or movement away from a computer terminal or other input media.

SUMMARY OF INVENTION

There are two embodiments of the invention, a preferred and an alternate. Both embodiments utilize a support arm assembly, which is mounted on a vertical support and an extension rod assembly which is suspended from the extended end of a support arm. Provision is made for horizontal rotation of the support arm and also for adjusting the arm angle with the vertical axis so that the extension rod assembly can be easily raised or lowered, or rotated sideways. The user fastens his documents to the rod assembly so that the drawings hang down.

In the preferred embodiment, the support arm assembly is mounted on top of a vertical floor-mounted stand, whereas for the alternate embodiment, the support arm assembly is mounted, slidably on a horizontal rail which is supported by three supports that can be table mounted or floor mounted. The alternate mounting configuration enables the support arm assembly to be slid on a horizontal rail over a distance from one support post to the other. This configuration may be more useful in some applications than the preferred embodiment configuration. However, the use of either configuration will greatly ease the normal difficulties in studying out-sized documents, particularly for chair-bound individuals.

Due to its design, the device significantly lessens the physical exertion and loss of concentration involved in the process of obtaining and comprehending information for out-sized documents.

With a document(s) affixed to the device, the user may readily access and comprehend any area of an out-sized document. While these characteristics are useful to a broad spectrum of users, an attribute of particular advantage to CAD/CAM user is the ability to position an out-sized document from virtually "In Your Face" to a position that does not obscure the monitor. Perpendicularity to the user and positioning may be controlled from a seated position and when in a seated position and locked, the user's hands are free.

Accordingly, it is a principal object of this invention to provide an apparatus which will function to hold out-sized documents and permit a user to adjust the location of the documents while remaining seated in a chair.

Another object is to provide an apparatus that is sturdy in design for durability.

An advantage of this invention is that it is of particular help to the physically impaired (i.e. Wheelchair bound) when being used for engineering or architectural purposes.

Further objects and advantages of this invention are: to provide simplicity in construction and to be inexpensive to manufacture. Other objects and advantages of this invention will become apparent from a consideration of the ensuing description and the drawings.

DESCRIPTION OF THE PREFERRED AND ALTERNATE EMBODIMENTS

Figure 1:
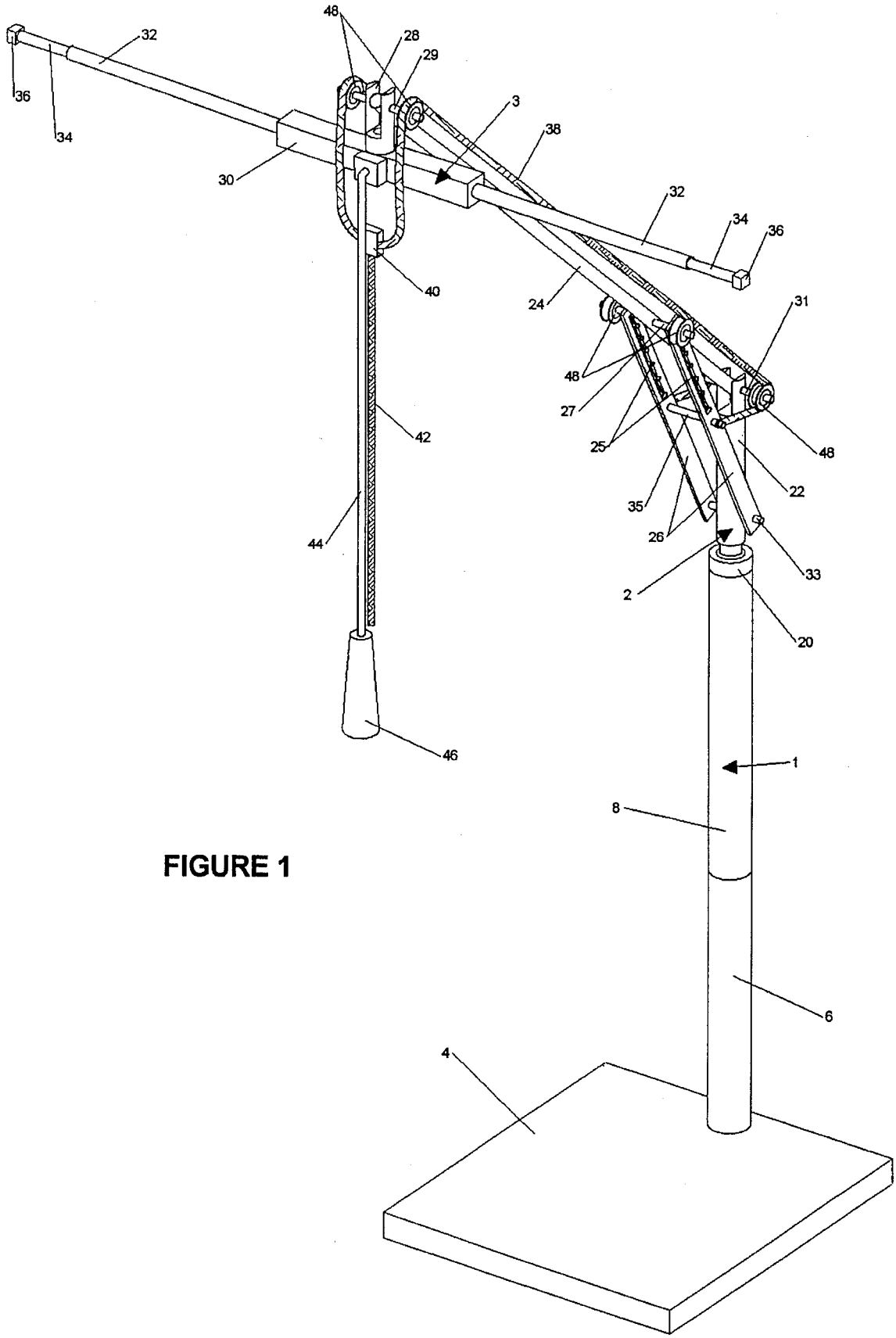
FIG. 1 is a perspective view of the preferred embodiment of the device according to the present invention.

Referring particularly to the drawings, there is shown in FIG. 1 a preferred embodiment of a device for holding outsized documents according to the present invention. The preferred embodiment comprises a floor-mounted vertical stand 1, a support arm assembly 2 which mounts to the top of the stand 1 and which includes a support arm 24 which extends outwards at an adjustable angle to the vertical axis, and a horizontal extension rod assembly 3 which is suspended at its center from the end of the support arm 24. Provision is made for rotating the support arm 24 horizontally around its vertical support, and for adjusting the vertical angle of the support arm 24 which effectively raises or lowers the extension rod assembly 3.

The extension rod assembly 3 is sized in width so that drawings or documents may be clipped to either side of its arms, or across its full width if necessary for display.

When in use, the apparatus is placed with its base 4 on the floor and as close to a seated user as is practical. The user maneuvers the orientation and location of the displayed documents by pulling down on a hanging pull-cord 42 with one hand, while firmly holding a guide handle 46 with the other hand. Two flat plate members 26 in parallel, provide adjustable cantilever support for the support arm 24. The plate members 26 are mounted on a first pivot pin 33 at their lower ends. The support arm 24 is pivoted at one end on a second pivot pin 31 located between the furcations of the forked end of a vertical yoke 22. The plate members 26 fasten to both sides of the support arm 24 with a third pivot pin 27 that passes through a notched slot 25 in each plate member 26. At any given support arm 24 vertical angle, the third pivot pin 27 will lodge in one of the notches in the notched slot 25, holding the support arm fixed in position.

In FIG. 1, the support arm 24 is shown at its highest angle, about 130 deg. with the vertical axis, or about 40 deg. with the horizontal plane. When the pull-cord 42 is pulled downwards, the pulling action is transmitted to the plate members 26 which pivot backwards a little on the first pivot pin 33. This causes the third pivot pin 27 to slip out of its notch in the notched slots 25, allowing the support arm 24 to rotate downwards in the slots 25. Firmly holding the guide handle 46 , which is attached rigidly by a rod 44 to the extension rod assembly 3 and thereby to an end of the support arm 24, prevents the support arm 24 from rotating downwards. The user can thus adjust the angle of the support arm downwards, releasing the pull-cord 42 and the plate members 26 and allowing the support arm 24 pivot pin 27 to fall into a lower notch in the slots 25 of the plate members 26.

The user may then use the guide handle 46 to swivel the pivot arm assembly 2 on its mount until the documents attached to the extension rod assembly 3 arms are in the desired location.

Raising the extension rod assembly 3 is done in the same way as lowering it except that the end of the support arm 24 has to be pushed up by pushing upwards with the guide handle 46 until the desired height is reached.

It should be noted that the combination of a rotatable, pivotable support arm 24, together with notch-slotted plate members 26 which act to lock the support arm 24 at various angles, is at the heart of the invention. Further, the apparatus component parts are designed and connected so that adjustment and locking of the support arm 24 at a given angle is remotely initiated at a distance from the locking mechanism. This permits the user to remain seated while adjusting the position of the documents held by the holding device, which is an obvious boon to a wheel-chair bound user as well as to a normally seated user.

Referring again to FIG. 1, the components of each assembly in the device are now discussed. The floor-mounted vertical stand 1 comprises a base 4, a lower tubular shaft 6, an upper tubular shaft 8 and a bearing shaft 20.

The base 4 is a flat, rigid plate having a hole bored and threaded through the plate, sized to mate with a threaded end of the lower tubular shaft 6. The lower tubular shaft 6 has one male threaded end and the other end is a female threaded socket. The threaded socket end of the lower tubular shaft 6 becomes its upper end when the lower tubular shaft is screwed into the base 4.

The upper tubular shaft 8 is the same as the lower tubular shaft 6 except for its upper socket end which is not threaded, but sized to receive and support the bearing shaft 20. The bearing shaft 20 is a short tubular member having about 60% of its length stepped down in diameter to snugly fit into the socket end of the of the upper tubular shaft 8. A socket is formed in the larger diameter portion of the bearing shaft 20 along its axis to receive and support the lower portion of the support arm assembly 2.

When the lower and upper tubular members 6, 8 are fastened together and to the base 4, and the bearing shaft 20 is inserted in place, a rigid, vertical support stand is produced for holding the support arm assembly 2.

As shown in FIG. 1, the support arm assembly 2 comprises a vertical pivoting yoke 22, a support arm 24 which pivots at one end on the pivoting yoke 22, two long, flat plate members 26 which are connected between the bottom of the pivoting yoke 22 and two opposite sides of the support arm 24, six guide wheels 48 which are mounted in pairs on the assembly, and a tension cord 38. Five pins 27, 29, 31, 33 and 35 are used either to join parts together, or to provide a pivot mount and to support the pairs of guide wheels 48. The guide wheels 48 function is to guide the tension cord 38, which has each end of the cord fastened to the approximate center of each locking plate 26 and therefrom the cord is guided in parallel over the guide wheels 48, leaving a cord loop dangling downwards over the projecting end of the support arm 24. It should be noted that additional pairs of guide wheels 48 could be mounted on the support arm 24 if it is desired, particularly if the support arm 24 is made very long, in order to properly guide the tension cord 38. At present, the applications envisioned do not require this addition.

The extension rod assembly 3 is shaped in the form of a cross and is connected, suspended from the projecting end of the support arm 24 by a slotted yoke 28 which is the top vertical portion of the "cross". The slotted yoke 28 is connected to the support arm 24 by a fastening pin 29, allowing the yoke and thereby the extension rod assembly to pivot around the end of the support arm 24 in a single plane, i.e. up and down. The cross arm of the assembly is composed of a center member 30, primary extension rods 32, one attached on either side of the center member 30, secondary extension rods 34 attached one to each primary extension rod 32, and a holding block 36 attached to each secondary extension rod 34. Both the primary and secondary extension rods are of tubular construction, with the secondary extension rod 34 having a smaller diameter so that it may slide into the larger diameter arm in telescoping fashion or be fixed in place. Thus, the overall length of the arms can be adjusted to suit the user.

The holding blocks 36 on each end of the arms are made of magnetic material, so that documents may be magnetically fastened and supported when a suitable metal clip is provided with the documents.

A guide rod 44 is rigidly attached to the center member 30 of the assembly cross arm and hangs downwards. The guide rod 44 includes a handle 46 which is attached at the free end of the rod for use by the equipment operator when raising, lowering or rotating the extension rod assembly 3.

A pull cord 42 hangs behind the guide rod 44 and is attached 40 to the looped portion of the tension cord 38 which is used adjust the angle of the support arm 24. The location of the pull cord 42 is particularly placed conveniently for use by an equipment operator, so that the handle 46 and the pull cord 42 may be used together when required.

In the foregoing description of the preferred embodiment of the device illustrated in the FIG. 1 drawing, it is clear that the device is intended to stand in one place, be it on a floor or on a table. The equipment operator has available to him, three possible directions for moving documents attached to the device extension arms: upwards, downwards and in an are from left to right or right to left. For typical use by a CAD (computer assisted drawing) operator who remains seated in one location, these three document movement directions should be adequate. However, in some conceivable working arrangements, the operators table may be wide, requiring the documents to be displayed and moved from one end of the table to the other. To meet this requirement, an alternate embodiment of the invention is proposed and is shown in FIGS. 2 and 2A.

It is a principal object of the alternate embodiment to provide a device where the displayed documents may be easily moved manually by a seated operator from one end of a table to the other end.

Figure 2:
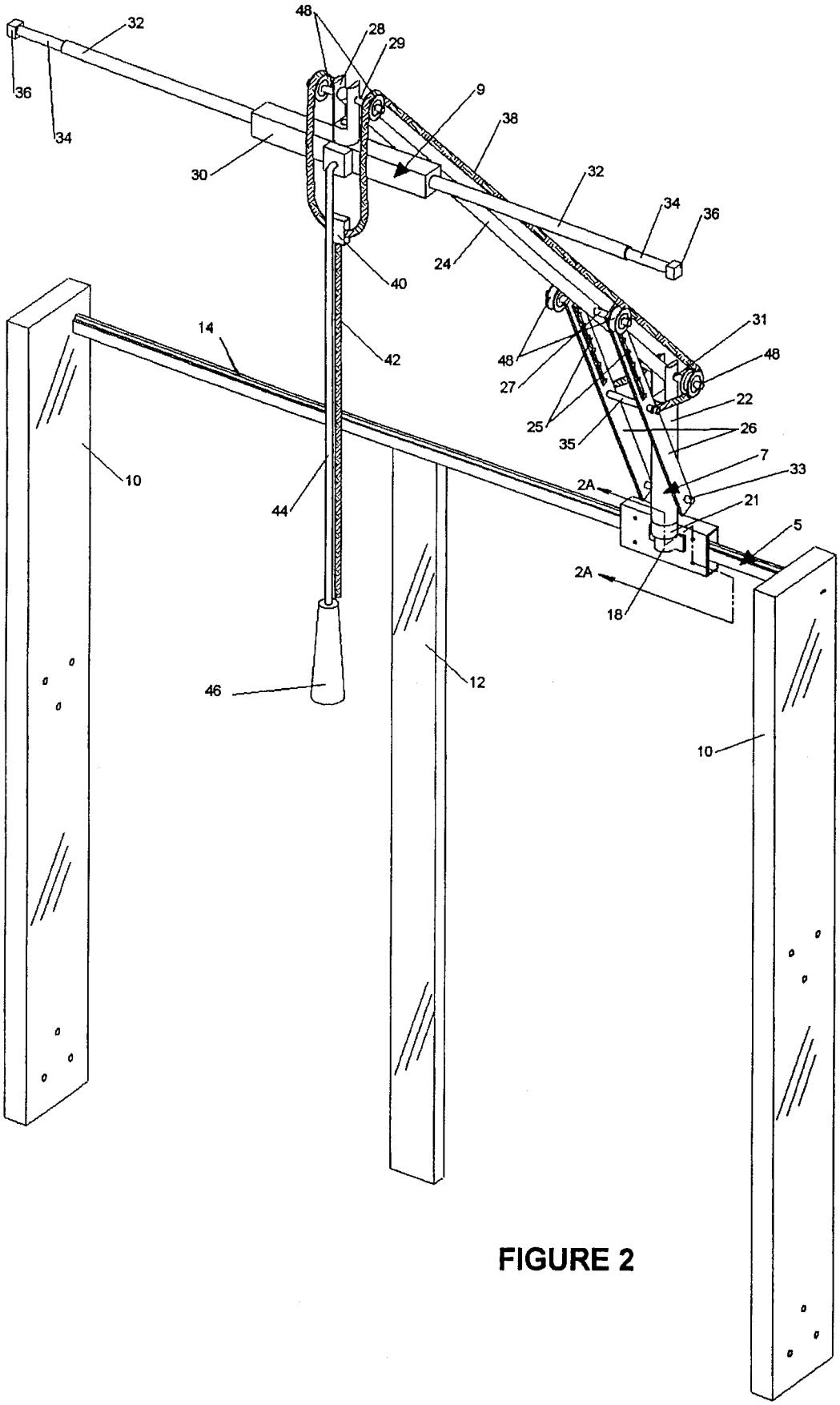
FIG. 2 is a perspective view of an alternate embodiment of the device according to the present invention.
Figure 2A:
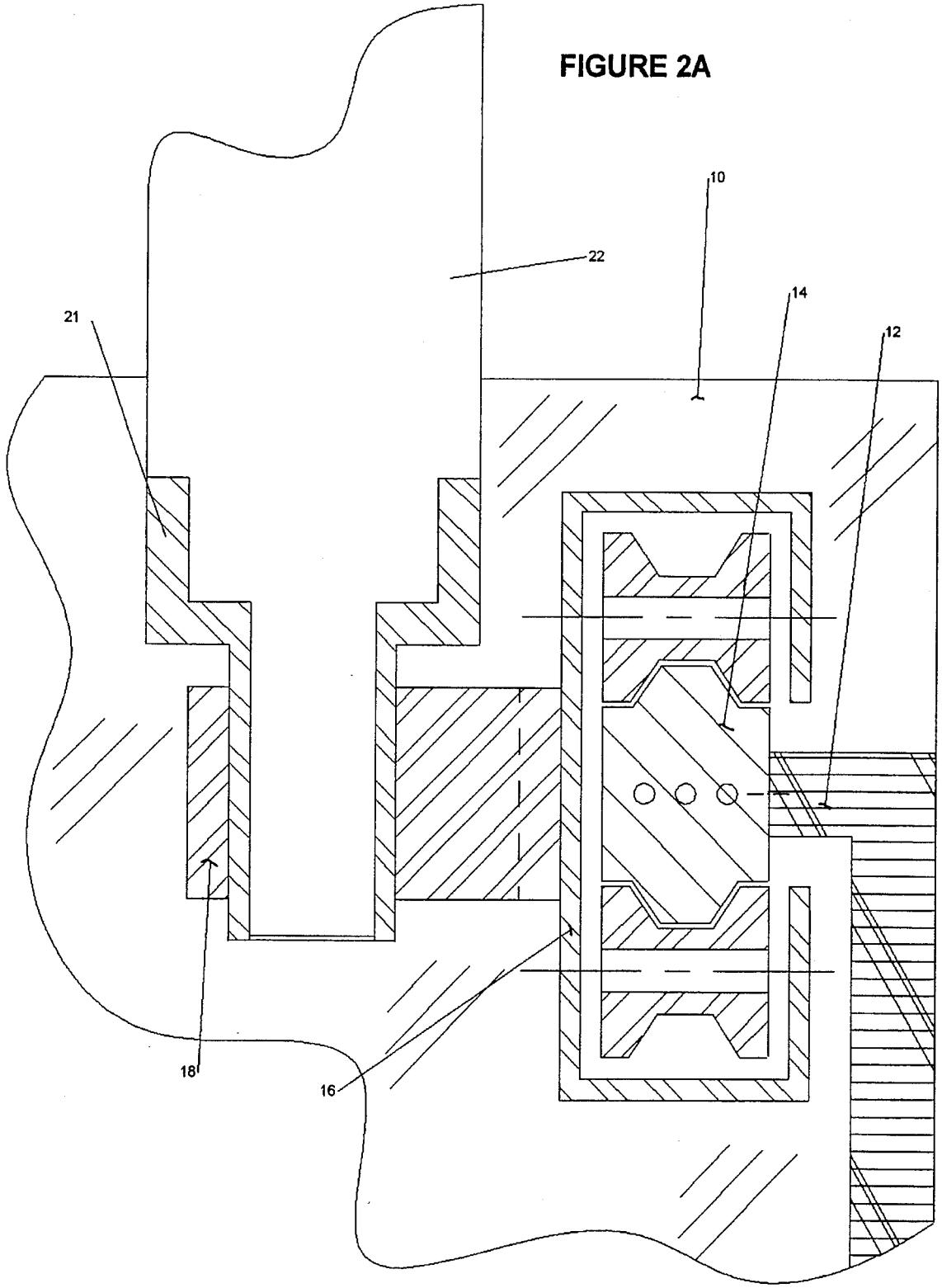
FIG. 2A is a cut-away view of a portion of the device taken along line 2A—2A of FIG. 2, and useful in explaining how one portion of the device can move along a supporting bar.

Refer now to FIGS. 2 and 2A which are respectively, a perspective view of an alternate embodiment of the present invention device, and a partial, cross-section view of the device taken along line 2A—2A of FIG. 2. In this embodiment, the support arm assembly 7 is able to slide horizontally on its mount over an appreciable distance instead of being fixed in a single location determined by the stand position as is the case for the preferred embodiment.

The vertical support stand 5 comprises two identical end legs 10, a center leg 12, a guide rail 14 which is held between the two end legs 10 and a sliding bracket mount 16 that rides on the guide rail 14. The guide rail 14 has a "V" shaped spline along its length on both its upper and lower surfaces to act as a rail. The bracket mount 16 includes a bearing shaft 21 which provides a socket support and attachment for the support arm assembly 7.

The legs 10, 12 may be short in length and adapted to stand on a table or they may be long and adapted for floor mounting. The guide rail 14 length selected for a given device depends on the particular application. Thus, a relatively long horizontal travel can be obtained for the support arm assembly 7 or a short travel distance as may be required.

Referring to FIG. 2A, it can be seen that the bracket mount 16 which rides on the guide rail 14, is constructed from a rectangular tubing member, bearing wheels, and a projecting member. It also includes a bearing shaft 21. The back vertical face of the tubing member is slit to permit the bracket mount 16 to move past the center support member while on the guide rail 14. Enclosed inside the rectangular tubing member are a number of bearing wheels which have "V" shaped grooves sized to ride on and under the guide rail 14, engaging the guide rail projecting spline. A projecting member, attached to the front vertical face of the tubing member has a vertical hole bored in it for seating the bearing shaft 21, providing a support for the shaft 21.

Referring again to FIG. 2, it should be understood that the components, structure and usage of the support arm assembly 7, and the extension rod assembly 9 are identical to the components, structure and usage described for the support arm assembly 2 and extension rod assembly 3 in FIG. 1 for the preferred embodiment. The components are therefore numbered to be exactly the same as shown in FIG. 1, and it is deemed unnecessary to repeat their description here.

From the foregoing description, the alternate embodiment configuration of the device is seen to include an ability to have the document holder portion of the device moved sideways by the user, while the user remains seated. This sideways direction movement is in addition to the vertical and horizontal arc movements otherwise available to the user. The object of the alternate embodiment is then achieved.

It is timely here to mention and point out several notable and highly desirable features and advantages of the device described and shown herein.

The ruggedness of the device allows placement in harsh environments such as shop floors etc. This also facilitates the device remaining functional in cases where packing, unpacking and frequent movement is a requirement.

The small footprint allows the device to be placed in cluttered areas where space is limited.

Several documents may be retained on the device at one time.

While in the examples given a particular application is addressed, they are not intended to nor should such examples be interpreted so as to limit the scope of this "Device For Holding Out-Sized Documents" described herein, but merely to provide an illustration of a preferred and alternate embodiment of this invention. For instance, this invention may be used as a stand-alone device in an alcove protected from the weather on a construction site. Therefore, the scope of this invention should be determined by the appended claims and their legal equivalents rather than by the examples given.

From the foregoing description, it is apparent that both the preferred and alternate embodiments achieve the objects of the present invention. Various modifications of the embodiments will be apparent from the above description to those skilled in the art. These and other alternatives are considered to be equivalent and within the spirit and scope of the present invention.

Having described the invention, what we claim is:

1. A device for holding out-sized documents, which comprises:

(a) a vertical support stand, comprising a base, a lower tubular shaft which is connected at one end vertically to the base, an upper tubular shaft which is connected at one end to the lower tubular shaft, and a short bearing shaft, said bearing shaft having a portion of its length stepped down in diameter to fit snugly inside the upper end of said upper tubular shaft, and having a socket formed in its larger diameter along its axis providing a bearing surface;

(b) a support arm assembly pivotally mounted on said support stand by connection to said socket in said bearing shaft, said support arm assembly comprising a vertical yoke having a forked end at its upper proximate end and a stepped down diameter portion at its distal end to fit in said bearing shaft, a first pivot pin mounted horizontally through a lower portion of said vertical yoke near to its distal end, a second pivot pin mounted between the furcations of the forked end of said vertical yoke and having ends projecting outwards from said furcations, a long arm member mounted pivotally at one end to said second pivot pin and functioning as an extended support arm, a third pivot pin mounted horizontally through said arm member and having ends projecting outwards, said third pivot pin being located at a distance approximately one fourth of the length of said arm member from said second pivot pin to apply a suitable point for application of lever action on said support arm, two flat plate members mounted one on each side of said arm member, each said plate member being fastened at near its proximate lower end to said first pivot pin, and at near its distal upper end to said third pivot pin, each said plate member having a long slot with multiple notches cut in its surface starting at near its distal upper end, said third pivot pin projecting through said slot and normally being held in any one of said notches, thereby providing cantilever support for said arm member, said slot with multiple notches in each plate member, acting together with said third pivot pin to provide a variable vertical angle locking position for said arm member;

(c) a fastening pin, said fastening pin connecting both said plate members at about their center, providing structural rigidity;

(d) an extension rod assembly comprising a yoke having a forked end, a fourth pivot pin, mounted between the furcations of the forked end of said yoke and having ends projecting outwards from said furcations, said fourth pivot pin being passed through the free end of said support arm which is fitted in said forked end of said yoke, for suspension of said yoke from the end of said support arm, a rectangular cross-section block member having its long axis fastened at its center to the bottom of said yoke at 90 degrees to the vertical axis of said yoke, two identical primary extension rods made of tubing, each primary extension rod being connected to an end of said block member in line so as to form a single horizontal arm composed of three parts, each said primary extension rod having a length long enough to support a large size document, and a guide rod, said guide rod being connected to the approximate center of said block member and at 90 degrees to the long axis of said block member so that said guide rod hangs downward, said guide rod including a handle fastened to its lower end for an equipment user, said guide rod enabling a user to remotely move said extension rod assembly up, down or in a horizontal arc around said vertical support stand; and (e) means for remotely adjusting the height position of said extension rod assembly in cooperation with said guide rod.

2. The device as defined in claim 1 wherein:

said means for remotely adjusting the height position of said extension rod assembly includes three pair of guide wheels, a tension cord and a pull cord; a first pair of said guide wheels being attached to said second pivot pin located near the top of said vertical yoke of said support arm assembly, a second pair of said guide wheels being attached to said third pivot pin located on said arm member, and a third pair of said guide wheels being attached to said fourth pivot pin located at the top of said extension rod assembly;

said tension cord being attached at both ends to the center of each plate member, and the two halves of the cord being fed under the first pair of guide wheels and thence over the second and third pair of guide wheels located on said arm member until the cord loop hangs down from said third pair of guide wheels over the front of said extension rod assembly, said pull cord being attached to the center of said cord loop and hanging downwards next to said guide rod, said tension cord and pull cord being located and connected such that a pull on said pull cord by a user will be transmitted to the center of both said plate members, causing said plate members to pivot backwards on said first pivot pin, releasing said third pivot pin on said arm member from a notch in said slot in said plate members and permitting said arm member and extension rod assembly to be raised or lowered to another supported position.

3. The device as defined in claim 1 wherein:

said extension rod assembly includes two secondary extension rods, each said rod having an outside diameter sized to fit slidingly inside the inside cavity of said primary extension rods for the purpose of adjusting the overall length of the horizontal arm.

4. The device according to claim 3 wherein:

a magnetic block is attached to the end of each said secondary extension rod, said block serving as an additional means of fastening documents having metal clips to said extension rod assembly for display.

5. A device for holding out-sized documents, which comprises:

(a) a support stand comprising a horizontal guide rail, a first leg and a second leg which support the guide rail between them, a third leg which supports the guide rail at its approximate center, and a slidable support bracket which rides on the guide rail;

said slidable support bracket comprising a short length of rectangular tubing having one of its sides open, including a multiplicity of guide wheels mounted inside said rectangular tubing, and located to engage bottom and top surface ridges on said guide rail while said bracket slides along said guide rail, a projecting member joined to the closed side of the rectangular tubing, said projecting member including a hole bored vertically at near its projecting end, and a bearing shaft which is seated in said hole on said projecting member, said bearing shaft including a socket cavity formed in its upper portion, providing a bearing surface for supporting equipment;

(b) a support arm assembly pivotally mounted on said slidable support bracket by connection to said socket in said bearing shaft, said support arm assembly comprising a vertical yoke having a forked end at its upper proximate end and a stepped down diameter portion at its distal end to fit in said bearing shaft, a first pivot pin mounted horizontally through a lower portion of said vertical yoke near to its distal end, a second pivot pin mounted between the furcations of the forked end of said vertical yoke and having ends projecting outwards from said furcations, a long arm member mounted pivotally at one end to said second pivot pin and functioning as an extended support arm, a third pivot pin mounted horizontally through said arm member and having ends projecting outwards, said third pivot pin being located at a distance approximately one fourth of the length of said arm member from said second pivot pin to apply a suitable point for application of lever action on said support arm, two flat plate members mounted one on each side of said arm member, each said plate member being fastened at near its proximate lower end to said first pivot pin, and at near its distal upper end to said third pivot pin, each said plate member having a long slot with multiple notches cut in its surface starting at near its distal upper end, said third pivot pin projecting through said slot and normally being held in any one of said notches, thereby providing cantilever support for said arm member, said slot with multiple notches in each plate member, acting together with said third pivot pin to provide a variable vertical angle locking position for said arm member;

(c) a fastening pin, said fastening pin connecting both said plate members at about their center, providing structural rigidity;

(d) an extension rod assembly comprising a yoke having a forked end, a fourth pivot pin, mounted between the furcations of the forked end of said yoke and having ends projecting outwards from said furcations, said fourth pivot pin being passed through the free end of said support arm which is fitted in said forked end of said yoke, for suspension of said yoke from the end of said support arm, a rectangular cross-section block member having its long axis fastened at its center to the bottom of said yoke at 90 degrees to the vertical axis of said yoke, two identical primary extension rods made of tubing, each primary extension rod being connected to an end of said block member in line so as to form a single horizontal arm composed of three parts, each said primary extension rod having a length long enough to support a large size document, and a guide rod, said guide rod being connected to the approximate center of said block member and at 90 degrees to the long axis of said block member so that said guide rod hangs downward, said guide rod including a handle fastened to its lower end for an equipment user, said guide rod enabling a user to remotely move said extension rod assembly up, down or in a horizontal arc around said vertical support stand; and (e) means for remotely adjusting the height position of said extension rod assembly in cooperation with said guide rod;

said support stand being configured in a manner permitting a user to remotely move said extension rod assembly, holding documents, horizontally from one side to the other as well as to raise or lower said extension rod assembly.

6. The device as defined in claim 5 wherein:

said means for remotely adjusting the height position of said extension rod assembly includes three pair of guide wheels, a tension cord and a pull cord; a first pair of said guide wheels being attached to said second pivot pin located near the top of said vertical yoke of said support arm assembly, a second pair of said guide wheels being attached to said third pivot pin located on said arm member, and a third pair of said guide wheels being attached to said fourth pivot pin located at the top of said extension rod assembly;

said tension cord being attached at both ends to the center of each plate member, and the two halves of the cord being fed under the first pair of guide wheels and thence over the second and third pair of guide wheels located on said arm member until the cord loop hangs down from said third pair of guide wheels over the front of said extension rod assembly, said pull cord being attached to the center of said cord loop and hanging downwards next to said guide rod, said tension cord and pull cord being located and connected such that a pull on said pull cord by a user will be transmitted to the center of both said plate members, causing said plate members to pivot backwards on said first pivot pin, releasing said third pivot pin on said arm member from a notch in said slot in said plate members and permitting said arm member and extension rod assembly to be raised or lowered to another supported position.

7. The device as defined in claim 5 wherein:

said extension rod assembly includes two secondary extension rods, each said rod having an outside diameter sized to fit slidingly inside the inside cavity of said primary extension rods for the purpose of adjusting the overall length of the horizontal arm.

8. The device according to claim 7 wherein:

a magnetic block is attached to the end of each said secondary extension rod, said block serving as an additional means of fastening documents having metal clips to said extension rod assembly for display.

* * * * *